US006874183B1

(12) United States Patent
Taylor

(10) Patent No.: US 6,874,183 B1
(45) Date of Patent: Apr. 5, 2005

(54) S-SHAPED PILLOW FOR FLEXIBLE BODY SUPPORT

(76) Inventor: Miriam Louise Taylor, 10085 Sunny La., Ooltewah, TN (US) 37363

( * ) Notice: Subject to any disclaimer, the term of this patent is extended or adjusted under 35 U.S.C. 154(b) by 0 days.

(21) Appl. No.: 10/727,415

(22) Filed: Dec. 4, 2003

(51) Int. Cl.[7] ..... A47G 9/00
(52) U.S. Cl. ..... 5/632; 5/630; 5/652
(58) Field of Search ..... 5/630, 632, 652, 5/636, 646, 648

(56) References Cited

U.S. PATENT DOCUMENTS

| | | | |
|---|---|---|---|
| D201,492 | S | 6/1965 | Jacobson |
| 4,173,048 | A | 11/1979 | Varaney |
| 4,624,021 | A | 11/1986 | Hofstetter |
| 4,754,510 | A | 7/1988 | King |
| 4,901,384 | A | 2/1990 | Eary |
| 5,097,551 | A | 3/1992 | Smith |
| 5,269,323 | A | 12/1993 | Krouskop |
| 5,497,519 | A | 3/1996 | Mintz |
| 5,522,104 | A | 6/1996 | Little |
| 5,573,014 | A | 11/1996 | Ginter |
| D382,435 | S | 8/1997 | Schaffner and Powell |
| 5,664,271 | A | 9/1997 | Bellavance |
| 5,815,863 | A | 10/1998 | Dolisi |
| 5,978,990 | A | 11/1999 | Akey |
| 5,987,674 | A | 11/1999 | Schaffner and Powell |
| 6,088,854 | A | 7/2000 | Brownrigg |
| 6,349,437 | B1 | 2/2002 | Horning |
| 6,499,164 | B1 | 12/2002 | Leach |

*Primary Examiner*—Michael Trettel

(57) ABSTRACT

A body support pillow having a semi-toroidal head support section (12), a substantially straight tubular back support section (14), and a semi-toroidal leg support section (16). To enhance range of motion, the head support section (12) terminates distally in a flared end (18), while the leg support section terminates distally in a tapered end (20). The proximate ends of the head support section (12) and the leg support section (16) are joined to the back support section (14) in an opposing manner to form an S-shaped pillow overall. Made of resilient and pliable material, the invention provides for direct, simultaneous, integrated, and flexible support of the head, back, legs, and feet of a side-lying individual, while allowing the ventral portion of the body to remain unobstructed. Hence the S-shaped body support pillow can be used to provide less stressful positions for anatomical members, contributing thereby to quality rest and sleep.

18 Claims, 5 Drawing Sheets

S-SHAPED PILLOW FOR FLEXIBLE BODY SUPPORT

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of Invention

This invention relates to pillows, specifically to a body pillow for an integrated and flexible support system for use by an adult or child lying on her side. The invention provides for direct and simultaneous support of the head, back, legs, and feet of an individual when resting or sleeping.

2. Description of Prior Art

Early pillows served to prop up the head when a person would sleep or to serve as a supporting bolster for other parts of the body, such as the torso or legs. Although some pillows acquired decorative properties and were utilized almost exclusively as household ornaments (for example, patent Des. 201,492 to Jacobson, 1965 Jun. 29, and patent Des. 382,435 to Schaffner and Powell, 1997 Aug. 19), the recognition of the pillow as an important body support has persisted over the years. Recent studies of body ergonomics and renewed attention to the benefits of quality rest and sleep have, in fact, highlighted the utilitarian function of supportive pillows.

Developments in pillow design have attempted to provide simultaneous support to various parts of the body in repose. Although this support may be accomplished by a plurality of pillows, such an approach can detract from quality rest, as the various pillows may reposition during sleep, thus negating much of the intended benefit.

In an endeavor to remedy the repositioning problem of separate body support elements, integrated pillow designs have been developed. The cushion-like support in U.S. Pat. No. 4,624,021 to Hofstetter, 1986 Nov. 25, provides an integrated support to the head, arms, and legs. It is limited, however, in requiring the user to embrace the pillow, thus bringing the pillow into contact with the chest and abdomen. By trapping heat on the ventral side of the body, an individual's body temperature can rise, bringing discomfort and negating, at least in part, the benefit of quality sleep. This support also impedes the arm on the downward side of the body from occupying a natural position at an angle similar to that of the arm on the upward side of the body, confining it to a position parallel to the torso. Such limitation of arm movement can also detract from quality rest. Furthermore, it is doubtful that a pillow on the ventral side of the body will provide adequate support to the back. Bolsters that best support the back are placed directly against the spine.

Similarly, the body pillow in U.S. Pat. No. 4,901,384 to Eary, 1990 Feb. 20, which consists of a number of interconnected foam strips, gives support to the head, arms, knees, and ankles, but does not provide dorsal support to the back of the user. Furthermore, the arm that must of necessity be positioned underneath the body pillow is substantially restricted in terms of free movement, a condition which can detract from quality rest.

The skeletal support pillow in U.S. Pat. No. 5,097,551 to Smith, 1992 Mar. 24, requires the individual to embrace the pillow and does not provide direct support to the back. Although the arm tunnel allows the arm on the downward side of the body to reside at a more comfortable position in relation to the body, it nevertheless impedes free movement of that arm, confining it to a fixed position in relation to the rest of the body.

Although providing simultaneous and integrated support for a user's head and limbs, the ergonomic pillow in U.S. Pat. No. 5,987,674 to Schaffner and Powell, 1999 Nov. 23, likewise requires an individual to embrace the pillow in order to achieve that support. Further, the pillow does not provide direct support to the back. Although intended to allow natural range of motion for the head and limbs, the weight of the pillow itself, as well as of the head, and of the arm and leg on the upward side of the body which rest on the pillow would limit the movement of the arm on the downward side of the body, which is confined under the pillow.

The body pillow in U.S. Pat. No. 6,499,164 to Leach, 2002 Dec. 31, provides simultaneous, integrated support to the head, back, and upper legs. It also allows a portion of the ventral side of the body, namely the chest and upper abdomen, to be exposed to ambient temperature. It is limited, however, in that a portion of the lower abdomen is covered by the pillow. Such ventral occlusion can contribute to the buildup of body heat. Furthermore, the design is limited in that it does not provide support for the feet, particularly the ankles. While it is conceivable that the user could hyperflex the knees in order to draw the feet up onto the pillow, such a position is unnatural for many individuals, who prefer to moderately extend the legs when at rest. Such a flexed position would also need to be rigidly maintained, thus detracting from natural movements that accompany a restful sleep.

Similarly, other pillows and support cushions, such as those found in U.S. Pat. No. 5,269,323, issued to Krouskop, 1993 Dec. 14, in U.S. Pat. No. 5,497,519, issued to Mintz, 1996 Mar. 12, in U.S. Pat. No. 5,522,104, issued to Little, 1996 Jun. 4, in U.S. Pat. No. 5,573,014, issued to Ginter, 1996 Nov. 12, in U.S. Pat. No. 5,664,271, issued to Bellavance, 1997 Sep. 9, in U.S. Pat. No. 5,815,863, issued to Dolisi, 1998 Oct. 6, and in U.S. Pat. No. 6,088,854, issued to Brownrigg, 2000 Jul. 18, do not provide simultaneous support to the head, back, legs, and feet; while other support pillows, such as those found in U.S. Pat. No. 4,173,048, issued to Varaney, 1979 Nov. 6, in U.S. Pat. No. 4,754,510, issued to King, 1988 Jul. 5, in U.S. Pat. No. 5,978,990, issued to Akey, 1999 Nov. 9, and in U.S. Pat. No. 6,349,437, issued to Horning, 2002 Feb. 26, require the user to embrace the pillow, thereby occluding the ventral side of the body and inhibiting the normal dissipation of body heat.

As may be seen, prior pillow and body support designs have endeavored to provide simultaneous, integrated support to various parts of the body while an individual rests or sleeps. While aspects of the problem have been partially addressed, these designs had and still have significant problems.

BRIEF SUMMARY OF THE INVENTION

This invention consists of an integrated S-shaped body support pillow for use by an adult or child lying on his side.

It provides for direct, simultaneous, and flexible support of the head, back, legs, and feet of an individual when resting or sleeping, thus fostering less stressful positions and facilitating range of motion for anatomical members, while concurrently allowing the ventral portion of the body, particularly in terms of the chest and abdomen, to remain unobstructed.

Objects and Advantages

Accordingly, several objects and advantages of my integrated body pillow are:

(a) to provide an integrated body pillow that simultaneously supports the head, back, legs, and feet during side-lying, thus eliminating the need for more than one pillow while resting or sleeping;

(b) to provide a body pillow that directly supports the head during side-lying at a physiologically neutral position related to the spine;

(c) to provide a body pillow that directly bolsters the back during side-lying;

(d) to provide a body pillow that directly relieves friction and numbing pressure between the knees through mesial support;

(e) to provide a body pillow that directly relieves friction and numbing pressure between the ankles through mesial support;

(f) to provide a body pillow that maintains normal joint position at the knee due to ankle support;

(g) to provide a body pillow that allows for varied head position in relation to the shoulders and spine;

(h) to provide a body pillow that allows for varied flexion at the hip while simultaneously supporting the thighs, knees, legs, ankles, and feet in normal anatomical relation;

(i) to provide a body pillow that allows for varied flexion of both knees; and (j) to provide a body pillow that, while yielding simultaneous support to various body parts, allows the ventral section of the body to remain unobstructed, thus facilitating heat dissipation and contributing to quality rest and sleep.

Additional objects and advantages are to provide a body pillow that allows for right or left side-lying preference, that grants support for knee flexion during supine repose, that supports ankle elevation during prone repose, and that can also serve as a back bolster, knee support, and an elevated surface on the lap of an individual while sitting.

Further objects and advantages of my body pillow will become apparent from a consideration of the drawings and ensuing description.

BRIEF DESCRIPTION OF THE SEVERAL VIEWS OF THE DRAWING

In the drawings, closely related figures have the same number but different alphabetic suffixes.

REFERENCE NUMERALS IN DRAWINGS

| | | | |
|---|---|---|---|
| 10 | body support pillow | 12 | head support section |
| 14 | back support section | 16 | leg support section |
| 18 | flared end | 20 | tapered end |
| 22 | notch | 24 | elliptical arc |
| 26a | first panel | 26b | second panel |
| 28 | panel-joining seam | 30 | closing mechanism |
| 32 | user | 34 | chamber |
| 36 | appliqué | | |

DETAILED DESCRIPTION OF THE INVENTION—FIGS. 1 TO 4A

Figure 1:
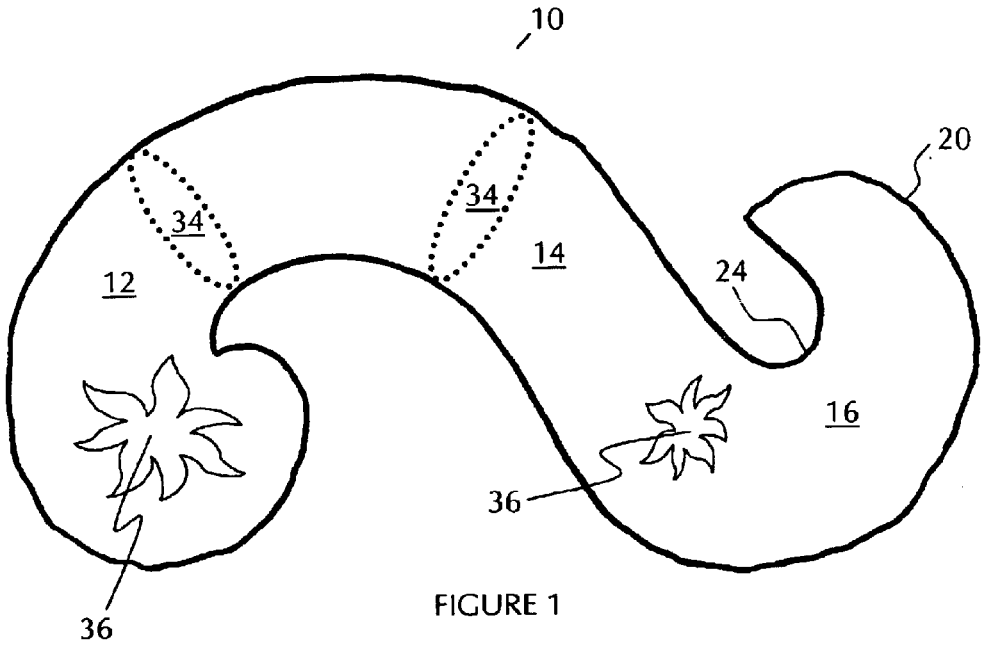
FIG. 1 shows a plan view of the S-shaped body pillow.

FIG. 1 shows a plan view of a basic version of my curvaceous or S-shaped body support pillow according to the invention. The specialized cushion-like support apparatus or body support pillow 10 is a unitary, flexible, and contoured article. As a continuous resilient structure having a distinctive shape, the pillow 10 comprises two semi-toroidal sections, namely a cephalic or head support section 12 and a somewhat smaller crural or leg support section 16, which are joined by a substantially straight elongate back support section 14. The head support section 12 and the leg support section 16, each of which form a curved opening, are joined to the back support section 14 in an opposing manner so as to create an S-shaped contour overall. As may be derived from FIGS. 2 and 3, the cross-sectional shape of each of these three tubular elements 12, 14, and 16 is generally elliptical or oval in nature.

As may be noted in FIG. 1, the head support section 12 generally terminates in an enlarged or flared end 18, while the leg support section 16 typically terminates in a reduced or tapered end 20, although these ends may vary somewhat in shape. The inner edge of the head support section 12 incorporates a cleft or notch 22, while the inner edge of the leg support section 16 comprises a smooth elliptical arc 24. The pillow may optionally incorporate a plurality of variable internal chambers 34 and variable external fanciful appliqués 36.

Figure 2:
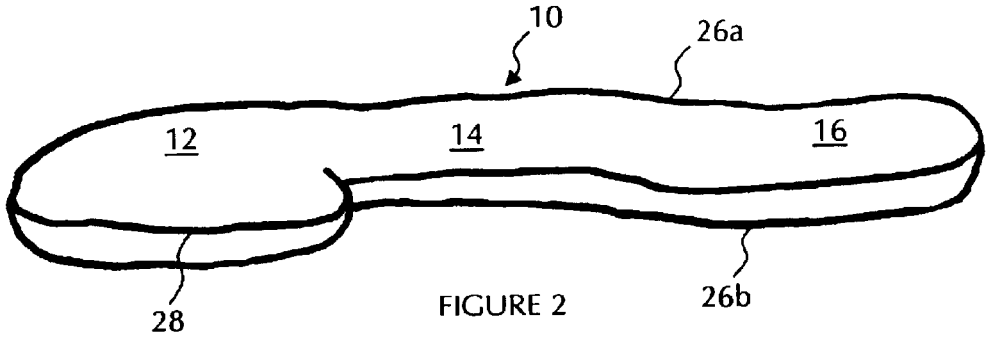
FIG. 2 shows a side elevational view of the S-shaped body pillow, corresponding to the proximate side of FIG. 1.
Figure 3:
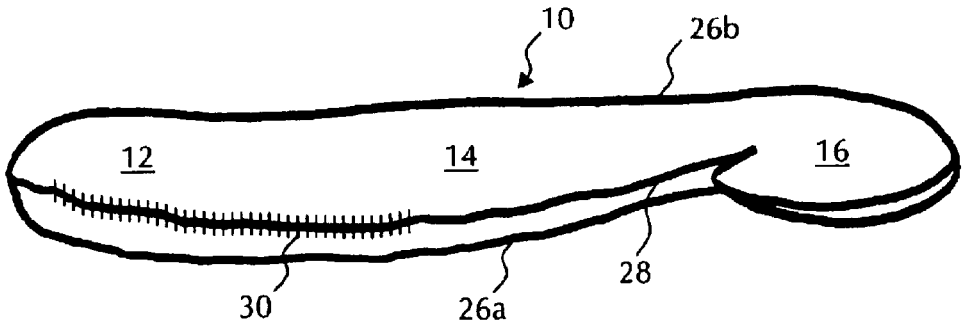
FIG. 3 shows a side elevational view of the S-shaped body pillow, corresponding to the distal side of FIG. 1.

As shown in FIGS. 2 and 3 depicting elevational (front and back) views, the casing of the S-shaped body pillow 10 is formed by two mirrored panels, a first panel 26*a* and a second panel 26*b*, typically of flexible woven fabric and of similar shape to the pillow 10. The first panel 26*a* and second panel 26*b* are sewn together face-to-face around the periphery in a panel-joining seam 28 or other joining method that is generally positioned at the longitudinal centerline of the sides of the completed pillow 10.

As may be observed in FIG. 3, a closing mechanism 30, such as a zipper, is inserted in the outer panel-joining seam 28 of the head support section 12, extending somewhat into the back support section 14 in order to permit introduction of filler material. With the closing mechanism in place, the joined panels are turned right-side-out and a suitable batting material (not shown), such as a natural, synthetic, or blended fiber, is inserted to fill the body support pillow 10 to a desirable degree of firmness.

Although the precise dimensions of the body support pillow 10 are custom fitted to the skeletal dimensions of an intended user 32 (FIG. 4) and hence vary proportionally according to her size, the distance from the outer edge of the head support section 12 to the outer edge of the leg support section 16 is generally the same as or slightly greater than the overall height of the user 32, from the top of the head to the feet. The outer diameter of the semi-toroidal head support section 12 is approximately the same as the distance from one elbow of the user 32 to the other, when the arms are extended perpendicular to the torso. The outer diameter of the semi-toroidal leg support section 16 is slightly greater than the length of the extended leg of the user 32, from the hip joint to the ankle.

Vertical thickness is dependent on the degree of support desired, but generally ranges from eight to twelve inches, with the back support section 14 having a thickness slightly greater than that of the head support section 12 or of the leg support section 16. As the body support pillow 10 is intended to be flexible, it should be noted that the dimensions provided apply to situations in which the pillow 10 is supported lengthwise by a planar surface and is not subject to external pressures other than those which are atmospheric in nature and normally present in the environment.

Operation of the Invention—FIGS. 4A to 7

Figure 4A:
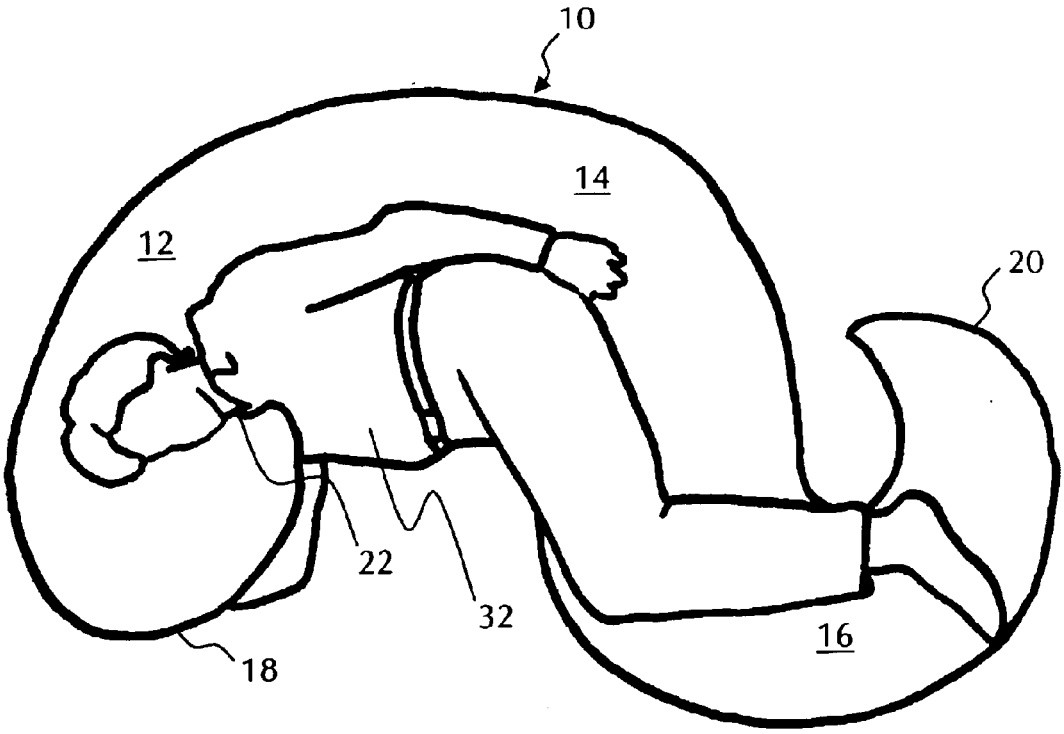
FIG. 4A shows a perspective view of the body pillow as it supports the user in a normal side-lying position.
Figure 4B:
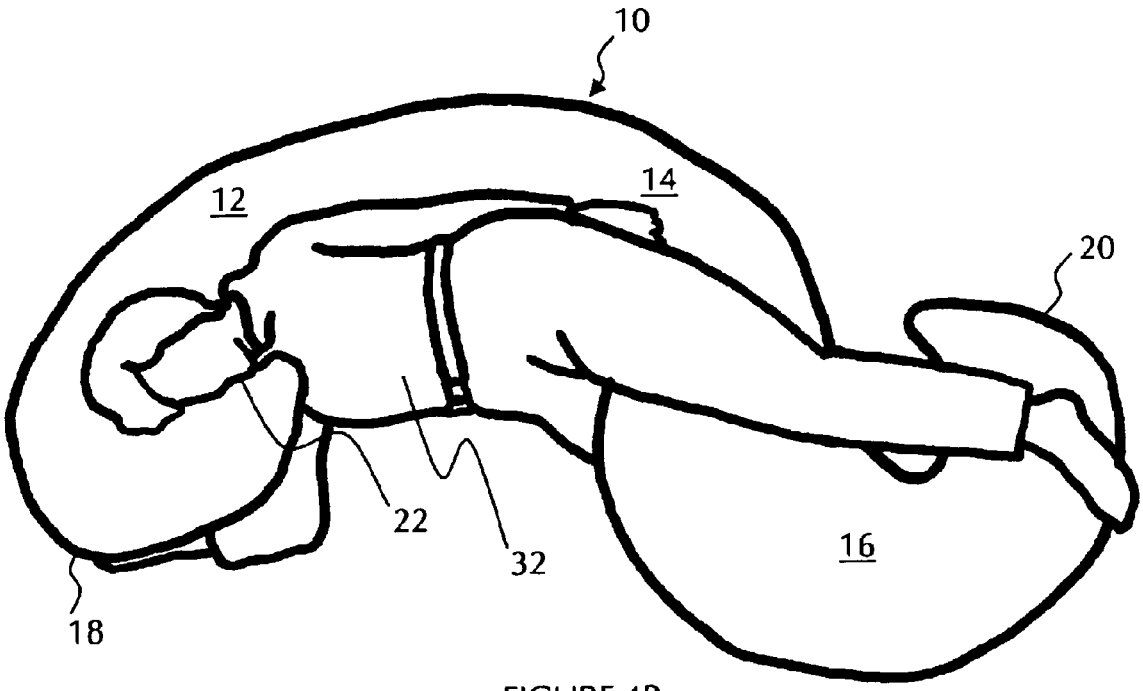
FIG. 4B shows a perspective view of the body pillow as it supports the user in a side-lying position of greater leg extension.

As shown in FIG. 4A, the principal manner of using the S-shaped pillow as a body support is in a lateral or side-lying position of the user 32. In this function, the head support section 12 of the body support pillow 10 fits under the head of the user 32, providing a head resting platform, while his posterior torso or back is directly bolstered by the back support section 14. The leg support section 16 of the pillow 10 fits between the legs of the user 32, thus providing mesial thigh, leg, and foot support and separating the pressure points of the knees and ankles.

With the body of the user 32 comfortably disposed in a side-lying position, the design of the body support pillow 10 also allows for range of motion for anatomical members. The flared end 18 of the head support section 12 allows the user 32 to flexibly position the head during rest and sleep, and can also provide resting support for the arm on the upper side of the body (not shown), if this is desired by the user 32. The notch 22 of the pillow 10 serves to cradle the shoulder, while the arm on the lower side of the body is free to position itself under the edge of the flared end 18 or to be exposed, as the user 32 would prefer. In the side-lying position, the tapered end 20 of the leg support section 16 allows the user 32 to extend the legs if desired and still receive mesial support to the ankles, as may be appreciated in FIG. 4B.

Figure 4C:
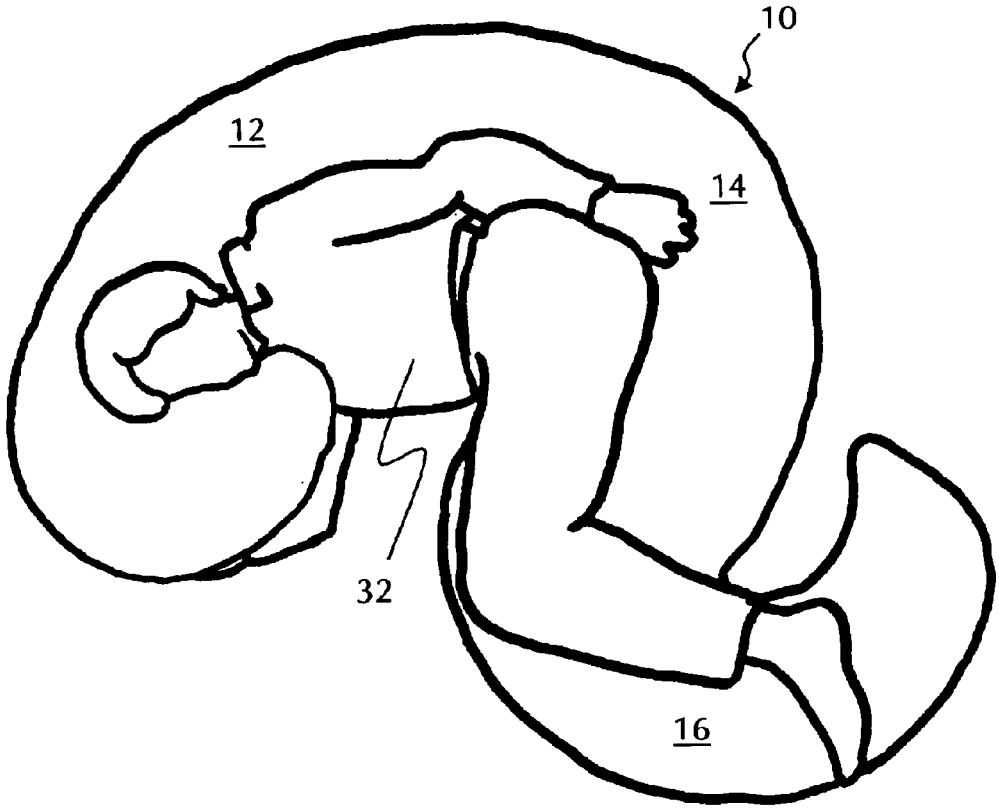
FIG. 4C shows a perspective view of the body pillow as it supports the user in a side-lying position of greater hip flexion.

FIG. 4C represents a side-lying position in which the hip joints are in a state of greater flexion. This fetal position may be preferred by some individuals and is facilitated by the design and flexible nature of the body support pillow 10.

Figure 4D:
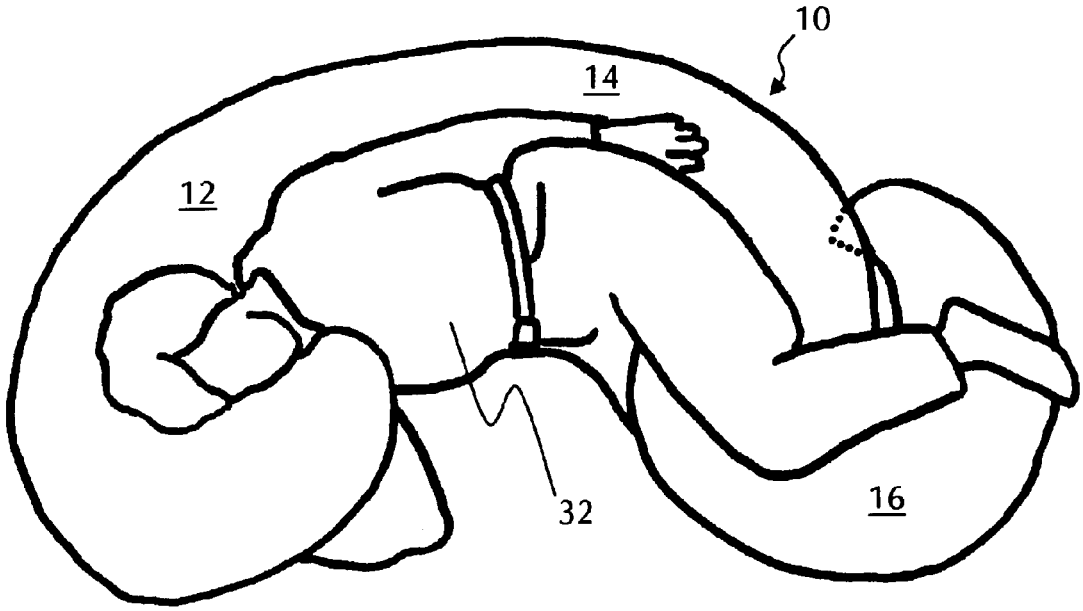
FIG. 4D shows a perspective view of the body pillow as it supports the user in a side-lying position of greater knee flexion.

FIG. 4D represents a side-lying position in which the knee joints are in a state of greater flexion. This leg position may be preferred by certain individuals and is facilitated by the design and flexible nature of the body support pillow 10.

Figure 4E:
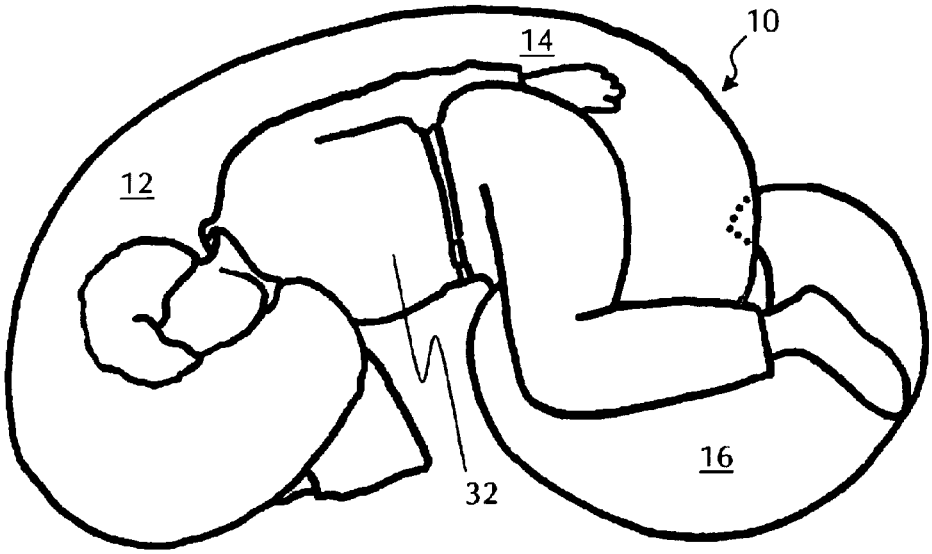
FIG. 4E shows a perspective view of the body pillow as it supports the user in a side-lying position of greater hip and knee flexion.

FIG. 4E represents a side-lying position in which both the hip and knee joints are in a state of greater flexion. This tightly curled position may be preferred by some individuals and is facilitated by the design and flexible nature of the body support pillow 10.

Figure 5:
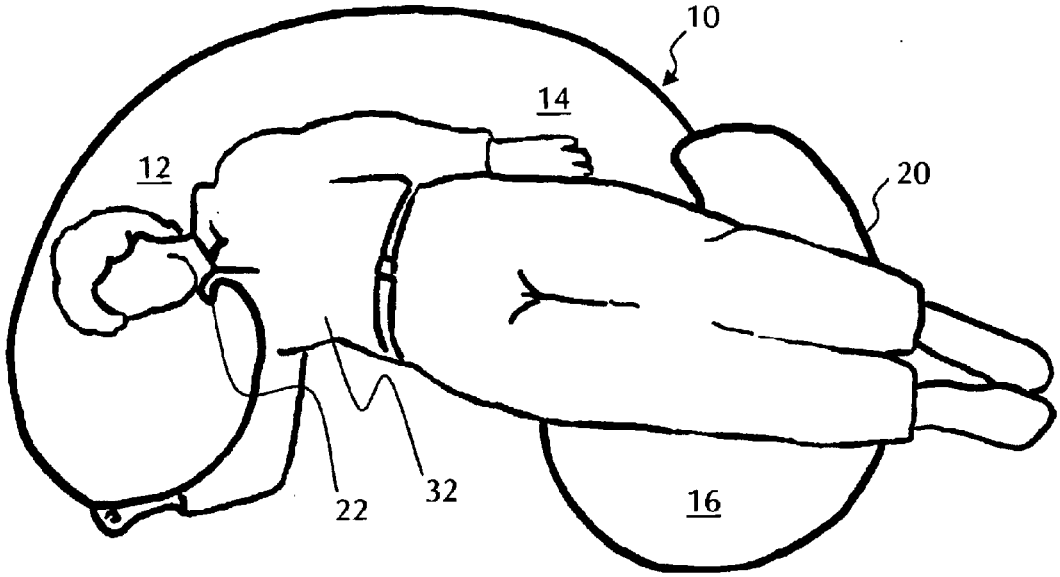
FIG. 5 shows a perspective view of the body pillow as it supports the user in an alternate supine position.

FIG. 5 represents an additional use of the body support pillow 10 in a supine or back-lying position, providing support to the head and legs of the user 32. In this modality, the shoulder of the user 32 is cradled by the notch 22 and the head rests on the head support section 12 of the pillow 10. The legs are supported by the leg support section 16 of the pillow 10, in which the tapered end 20 is brought into close proximity with the back support section 14, made possible by the flexible nature of the pillow 10. This supported position allows for a moderate degree of flexion at the knees, which some individuals may prefer while at rest and which is often difficult to achieve when lying on the back.

Figure 6:
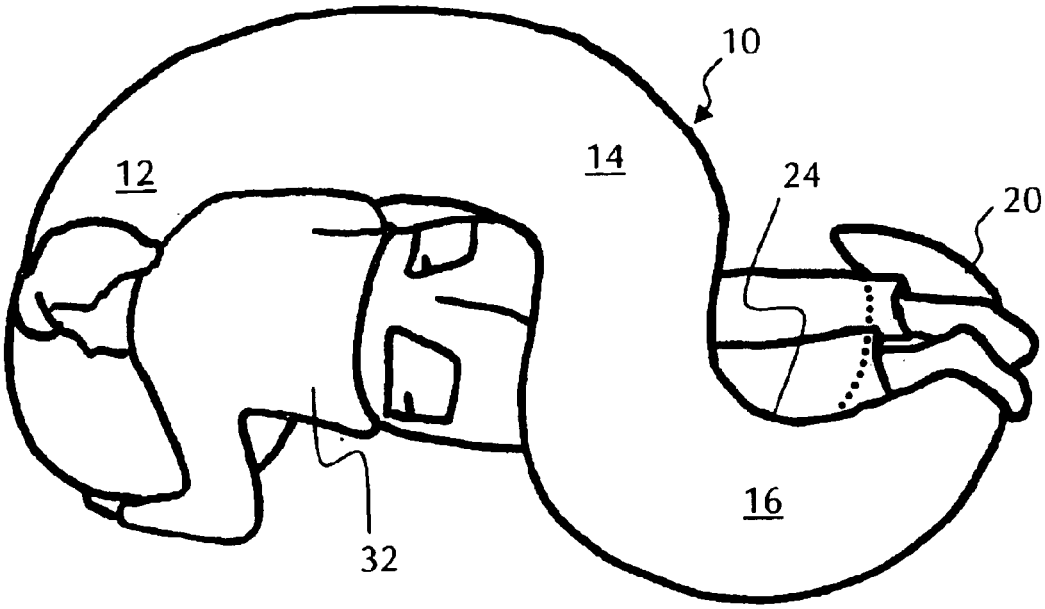
FIG. 6 shows a perspective view of the body pillow as it supports the user in an alternate prone position.

FIG. 6 represents an additional use of the body support pillow 10 in a prone position, providing support for the head and ankles of the user 32. In this modality, the head of the user 32 rests on the head support section 12 of the pillow 10, while the ankles are supported by the tapered end 20 of the leg support section 16, the legs passing through the elliptical arc 24. This allows for flexion of the knees and elevation of the ankles, which may be preferred by some individuals while at rest and which is often difficult to achieve in a prone position.

Figure 7:
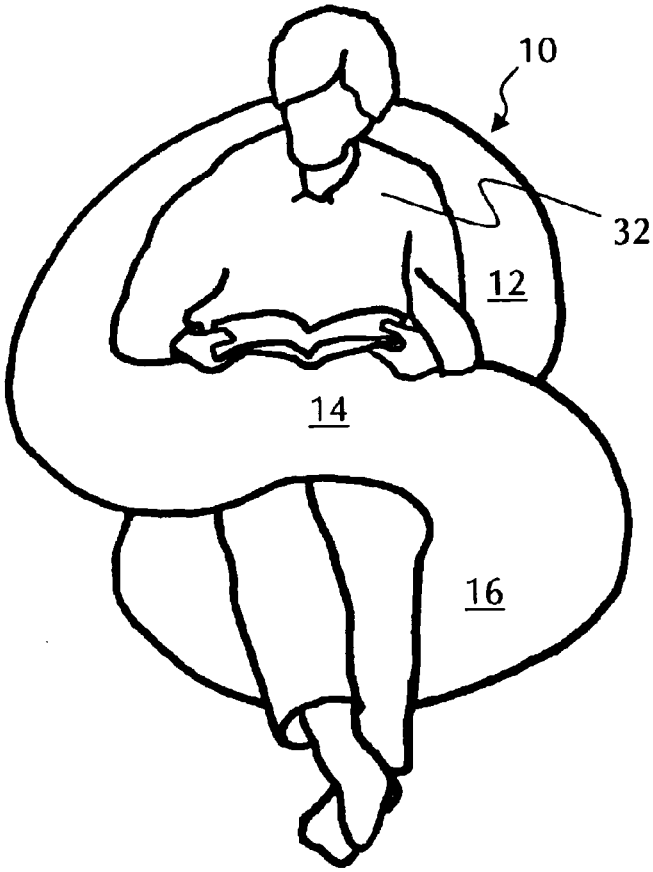
FIG. 7 shows a perspective view of the body pillow as it supports the user in an alternate sitting position.

FIG. 7 represents an additional use of the body support pillow 10 in a sitting position, providing support for the back and knees of the user 32. In this modality, the back of the user 32 rests against the head support section 12 of the pillow 10, which is supported, in turn, by an extended vertical surface, such as a wall or a headboard of a bed (not shown). The back support section 14 of the pillow 10 passes over the thighs and can serve as an elevated surface on the lap of the user 32, such as to support a book for reading. The knees of the user 32 are supported by the leg support section 16 of the pillow 10, permitting a moderate flexion of the knees, which can enhance comfort for the user 32 when seated on a planar surface, such as a bed or a floor.

Advantages of the Invention

From the description above, a number of advantages of my body support pillow become evident:

(a) The pillow provides integrated and simultaneous support to the head, back, legs, and feet of the user during side-lying, thus avoiding the problem of repositioning multiple support pillows while resting or sleeping.

(b) With the pillow, the user is able to maintain a natural anatomical position of the head, spine, and legs while resting or sleeping in either a right- or left-side-lying position, thus enhancing comfort and minimizing fatigue in the neck, back, and legs.

(c) The flared end of the pillow provides for a range of support positions for the head in relation to the shoulders and spine.

(d) The contoured design of the pillow allows direct support to the back during side-lying, while directly relieving numbing pressure, friction, and abrasion between the knees and ankles through intervening support.

(e) With the ankle support provided by the pillow, the user is able to avoid abnormal position of the knee joint while in repose.

(f) The flexible nature of the body support pillow allows for varied flexion at the hip and knees, enhancing natural movement while at rest or sleep.

(g) The user can experience greater personal comfort and quality rest and sleep, given that the pillow allows the region of the chest and abdomen to remain unobstructed, thus facilitating heat dissipation.

(h) Additional modalities of the body support pillow provide support for knee flexion during supine repose, leg and ankle elevation during prone repose, and back and knee support when used in a sitting position. Use of the pillow while sitting also gives an elevated surface on the lap, which could be used, for example, to hold a book for reading.

CONCLUSION, RAMIFICATIONS, AND SCOPE

Thus the reader will see that the body support pillow of the invention provides a direct, simultaneous, integrated, and flexible support to the head, back, legs, and feet of an individual while in a side-lying position of rest or sleep. It further can provide support in supine, prone, and sitting positions. The body support pillow is also a device that can be used by persons of either sex and of almost any age, as a regular sleep or rest support for able individuals or in therapeutic situations, such as for disabled or convalescent patients.

While my above description contains many specificities, these should not be construed as limitations on the scope of the invention, but rather as an exemplification of the preferred embodiment thereof. Many other variations and ramifications are possible, which those skilled in the art may now make without departing from the inventive concepts disclosed.

The body support pillow, for example, could be prepared with various types of batting material to provide differing degrees of support, from very soft to very firm, with cushioning materials of natural fiber or synthetic fiber origins, foam, or down. The cushioning material could also include air or any fluid, such as water or gel, which could optionally be introduced by the user. The amount of fill utilized could also be varied to accommodate personal preference or body weight. The pillow could also incorporate chambers, quilting stitches, or other means to control the movement of the cushioning material within the casing. The pillow could also incorporate creative and fanciful appliqué means, providing the semblance of a stuffed toy.

The pillow could be covered with various types of fabric, so as to enhance durability, texture, comfort, and even aesthetic appeal. Fabric options include natural textiles, synthetic textiles, or blended textiles, as well as elastisized natural, synthetic, or blend materials, among others. The casing panels could be integrally formed or composed of multiple parts. The body support pillow could also include a removable, washable slipcover over the casing.

The body support pillow may also be designed in various dimensions for a child or teen, or to match various body proportions, such as the relation of the length of the torso to the length of the legs, or dependent upon the body build. Due to the distinctive shape of the pillow, it may be easily adapted into a fanciful stuffed toy for children. It could also house suitable devices for the production of heat, vibration, scent, or sound, such as music, heartbeats, or environmental acoustics, or any combination thereof.

Although the invention has been described for illustrative purpose with reference to particular shapes, processes, and materials, these should not be construed as limiting the scope of the present invention. Rather, the scope of the invention should be determined by the appended claims and their legal equivalents.

What I claim as my invention is:

1. A body support pillow conforming substantially to the bodily skeletal dimensions of a user comprising:

(a) a semi-toroidal head support section, having a proximate end and a distal flared end, (b) a semi-toroidal leg support section, having a proximate end and a distal tapered end, and (c) a substantially straight tubular back support section, joined at one end to said proximate end of said head support section and joined at the opposite end to said proximate end of said leg support section, with said head support section and said leg support section positioned in opposing orientation so as to form an S-shaped contour overall, whereby the head, back, legs, and ankles of said user in a side-lying position are simultaneously and flexibly supported by said pillow, allowing for a range of motion, and whereby the region of said user's front chest and abdomen remains unobstructed to a surrounding environment.

2. A body support pillow according to claim 1 wherein said leg support section is smaller in diameter than said head support section.

3. A body support pillow according to claim 1, further including a shoulder notch in the inner arc of said head support section.

4. A body support pillow according to claim 1, further including a casing, said casing conforming to the shape of said pillow.

5. A body support pillow according to claim 4, further including a predetermined filler means introduced within said casing, thereby providing resilient and deformable support surfaces for said pillow.

6. A body support pillow according to claim 5, further including a slip cover, said cover conforming to the shape of said pillow.

7. A body support pillow according to claim 5, further including a closing means along a predetermined portion of the periphery of said pillow, whereby said user can introduce and remove said filler means.

8. A body support pillow according to claim 6 wherein said casing and said cover are provided with a closing means along a predetermined portion of the periphery of said pillow, whereby said user can introduce and remove said filler means, as well as more easily remove and replace said cover.

9. A body support pillow according to claim 4, further including a plurality of chambers to separately house portions of said filler means, whereby substantially differing degrees of firmness can be maintained in predetermined elements of said pillow.

10. A body support pillow conforming substantially to the bodily skeletal dimensions of a child comprising:

(a) a semi-toroidal head support section, having a proximate end and a distal flared end, (b) a semi-toroidal leg support section, having a proximate end and a distal tapered end, (c) a substantially straight tubular back support section, joined at one end to said proximate end of said head support section and joined at the opposite end to said proximate end of said leg support section, with said head support section and said leg support section positioned in opposing orientation so as to form an S-shaped contour overall, and (d) creative and fanciful applique means, providing the semblance of a stuffed toy, whereby the head, back, legs, and ankles of said child in a side-lying position are simultaneously and flexibly supported by said pillow, allowing for a range of motion, whereby the region of said child's front chest and abdomen remains unobstructed to a surrounding environment, and whereby said child may experience greater motivation to utilize said pillow as a support device due to its whimsical nature.

11. A body support pillow according to claim 10 wherein said leg support section is smaller in diameter than said head support section.

12. A body support pillow according to claim 10, further including a shoulder notch in the inner arc of said head support section.

13. A body support pillow according to claim 10, further including a casing, said casing conforming to the shape of said pillow.

14. A body support pillow according to claim 13, further including a predetermined filler means introduced within said casing, thereby providing resilient and deformable support surfaces for said pillow.

15. A body support pillow according to claim 14, further including a slip cover, said cover conforming to the shape of said pillow.

16. A body support pillow according to claim 14, further including a closing means along a predetermined portion of the periphery of said pillow, whereby said user can introduce and remove said filler means.

17. A body support pillow according to claim 15 wherein said casing and said cover are provided with a closing means along a predetermined portion of the periphery of said pillow, whereby said user can introduce and remove said filler means, as well as more easily remove and replace said cover.

18. A body support pillow according to claim 13, further including a plurality of chambers to separately house portions of said filler means, whereby substantially differing degrees of firmness can be maintained in predetermined elements of said pillow.

* * * * *